US010982558B2

(12) United States Patent
Mairhanser et al.

(10) Patent No.: US 10,982,558 B2
(45) Date of Patent: Apr. 20, 2021

(54) GUIDE VANE CONNECTION

(71) Applicant: MTU Aero Engines AG, Munich (DE)

(72) Inventors: Vitalis Mairhanser, Sigmertshausen (DE); Stephen Royston Williams, Seefeld (DE); Werner Humhauser, Moosburg (DE)

(73) Assignee: MTU AERO ENGINES AG, Munich (DE)

( * ) Notice: Subject to any disclaimer, the term of this patent is extended or adjusted under 35 U.S.C. 154(b) by 126 days.

(21) Appl. No.: 16/211,483

(22) Filed: Dec. 6, 2018

(65) Prior Publication Data

US 2019/0178096 A1 Jun. 13, 2019

(30) Foreign Application Priority Data

Dec. 7, 2017 (DE) ..... 10 2017 222 209.3

(51) Int. Cl.
*F01D 9/04* (2006.01)
*F04D 29/56* (2006.01)
(Continued)

(52) U.S. Cl.
CPC ..... *F01D 9/041* (2013.01); *F01D 17/162* (2013.01); *F01D 19/00* (2013.01); *F04D 29/563* (2013.01);
(Continued)

(58) Field of Classification Search
CPC ..... F01D 9/041; F01D 17/162; F01D 19/00; F04D 29/563; F05D 2250/131;
(Continued)

(56) References Cited

U.S. PATENT DOCUMENTS 2,651,496 A * 9/1953 Buckland ..... F01D 9/065 415/135
3,764,189 A * 10/1973 Prostler ..... F01D 5/288 384/278
(Continued)

FOREIGN PATENT DOCUMENTS

DE 3613857 A1 * 10/1987 ..... F04D 29/462
DE 195 37 784 A1 6/1996
(Continued)

OTHER PUBLICATIONS https://www.halder.com/at/Produkte/Normalien/Bedienteile/Spannhebel (2017).

*Primary Examiner* — J. Todd Newton
(74) *Attorney, Agent, or Firm* — Barlow, Josephs & Holmes, LTD.

(57) ABSTRACT

Disclosed is a lever linkage for the rotationally fixed connection of a guide vane to a lever of a guide vane adjusting device of a turbomachine, wherein the guide vane has a vane shaft, which extends along a vertical axis. In accordance with the invention, the lever is formed in one piece at a radially outer end of an essentially hollow cylindrical clamping sleeve, which coaxially surrounds the vane shaft in sections, and the vane shaft and the clamping sleeve are coupled by way of a longitudinal side form-fitting connection or a front-end form-fitting connection, and the vane shaft can be tensioned with the clamping sleeve along the vertical axis by means of a fastening element, in particular a threaded nut. In consequence thereof, a separation of two different force flows that act on the guide vanes is obtained, as a result of which local load peaks are reduced.

12 Claims, 8 Drawing Sheets

Figure 1:
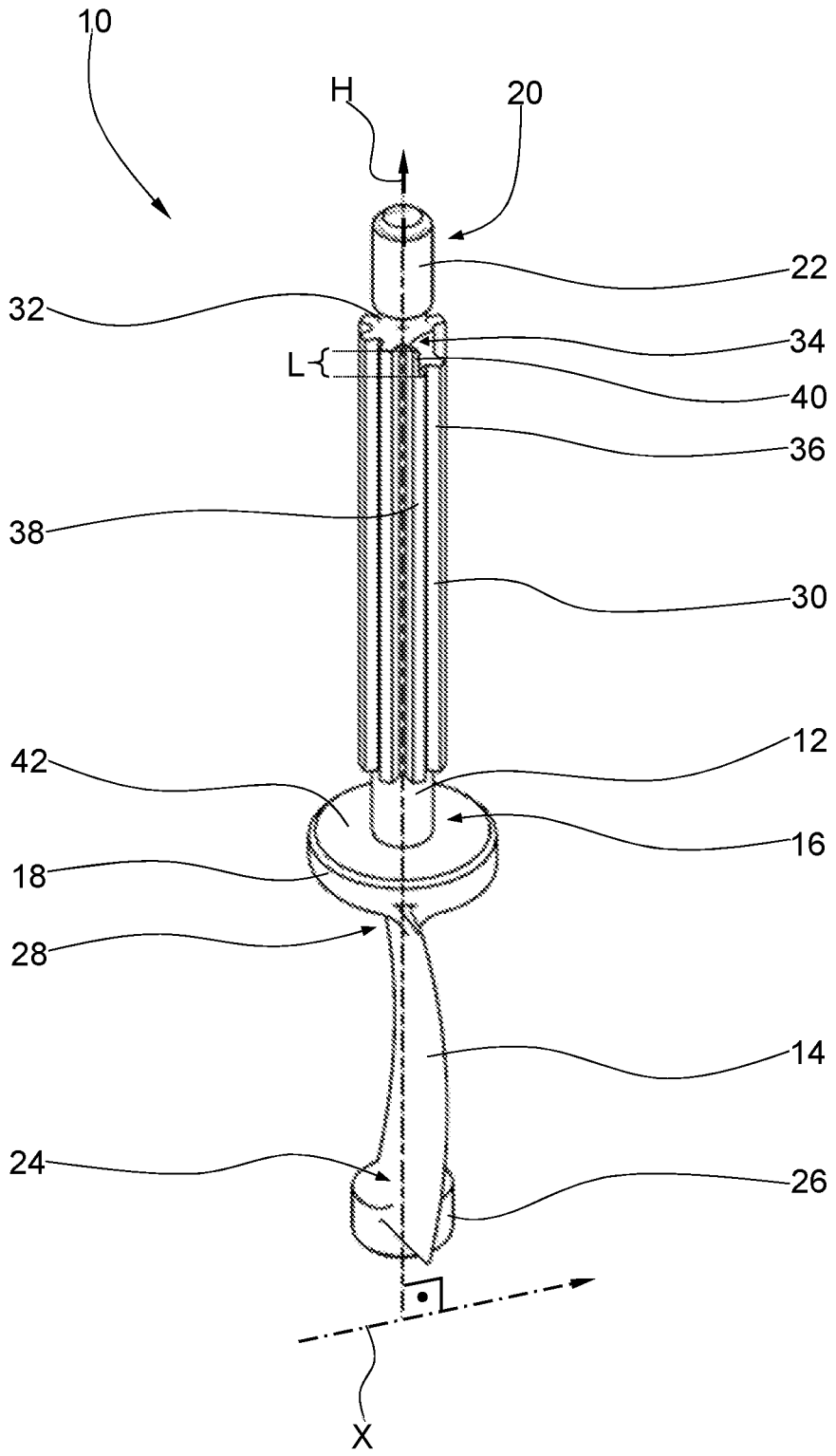

(51) Int. Cl.
*F01D 17/16* (2006.01)
*F01D 19/00* (2006.01)

(52) U.S. Cl.
CPC ..... *F05D 2220/323* (2013.01); *F05D 2220/3217* (2013.01); *F05D 2220/3219* (2013.01); *F05D 2230/60* (2013.01); *F05D 2240/12* (2013.01); *F05D 2250/131* (2013.01); *F05D 2260/36* (2013.01); *F05D 2260/37* (2013.01); *F05D 2260/85* (2013.01)

(58) Field of Classification Search
CPC ..... F05D 2260/36; F05D 2260/37; F05D 2220/3217; F05D 2220/3219; F05D 2220/323; F05D 2230/60; F05D 2240/12; F05D 2260/85
USPC ..... 415/148
See application file for complete search history.

(56) References Cited

U.S. PATENT DOCUMENTS 4,834,613 A * 5/1989 Hansen ..... F01D 17/162 415/160
4,867,636 A * 9/1989 Sauron ..... F03B 3/183 415/160
5,230,605 A * 7/1993 Yamaguchi ..... F01D 17/162 415/151
5,342,169 A * 8/1994 Muller ..... F01D 17/162 415/160
5,492,446 A * 2/1996 Hawkins ..... F01D 17/162 411/116
5,601,401 A * 2/1997 Matheny ..... F01D 17/162 415/160
5,636,968 A * 6/1997 Audet ..... F01D 17/162 415/160
6,019,574 A * 2/2000 DiBella ..... F01D 17/162 415/148
6,086,327 A * 7/2000 Mack ..... F01D 17/162 384/273
6,398,483 B1 * 6/2002 Conete ..... F01D 17/162 415/130
6,413,043 B1 * 7/2002 Bouyer ..... F01D 9/042 29/451
6,481,960 B2 * 11/2002 Bowen ..... F01D 11/001 415/160
6,767,183 B2 * 7/2004 Schilling ..... F01D 17/162 415/160
7,614,846 B2 * 11/2009 Foucher ..... F01D 17/162 415/161
8,393,857 B2 * 3/2013 Copeland ..... F01D 17/162 415/160
9,926,944 B2 * 3/2018 Mouton ..... F04D 29/563
9,932,988 B2 * 4/2018 Maliniak ..... F04D 29/563
10,393,145 B2 * 8/2019 Medina Cruz ..... F01D 17/162
10,526,911 B2 * 1/2020 Pratt ..... F01D 9/041
10,590,795 B2 * 3/2020 Pratt ..... F02C 9/20
2003/0143067 A1 * 7/2003 Bouru ..... F04D 29/563 415/150
2004/0240990 A1 * 12/2004 Rockley ..... F01D 17/162 415/148
2005/0276686 A1 * 12/2005 Bruce ..... F04D 29/563 415/160
2006/0029494 A1 * 2/2006 Bruce ..... C23C 28/322 415/160
2006/0062667 A1 * 3/2006 Bourgoin ..... F04D 29/563 415/199.1
2006/0285969 A1 * 12/2006 Maurice Ribassin ... F01D 17/16 415/160
2008/0206045 A1 * 8/2008 Foucher ..... F01D 17/162 415/160
2010/0092278 A1 * 4/2010 Major ..... F04D 29/563 415/160
2010/0172744 A1 * 7/2010 Bhatnagar ..... F01D 17/162 415/160
2011/0020120 A1 * 1/2011 Redgwell ..... F01D 17/162 415/213.1
2011/0058931 A1 3/2011 Domercq et al.
2013/0129487 A1 * 5/2013 Colette ..... F01D 17/162 415/148
2014/0219785 A1 * 8/2014 Gasmen ..... F04D 29/563 415/148
2015/0377061 A1 * 12/2015 Boeck ..... F01D 9/04 415/160
2016/0032759 A1 * 2/2016 Gasmen ..... F01D 9/041 415/148
2016/0123177 A1 * 5/2016 Osborne ..... F01D 17/162 60/805
2017/0081975 A1 * 3/2017 Zagone ..... F02C 9/20
2019/0264574 A1 * 8/2019 Kjelby ..... F02C 3/06

FOREIGN PATENT DOCUMENTS

DE 699 22 382 T2 11/2005
DE 603 04 908 T2 12/2006
DE 19537784 B4 3/2007
DE 102012201135 A1 8/2013
EP 0090918 A2 10/1983
EP 1010863 A2 * 6/2000 ..... F01D 25/28
EP 1637742 A2 3/2006
EP 1777375 A1 4/2007
GB 2 412 947 A 10/2005
WO 2014/158455 A1 2/2014
WO 2015/026420 A1 2/2015

* cited by examiner

GUIDE VANE CONNECTION

BACKGROUND OF THE INVENTION

The invention first relates to a lever linkage for rotationally fixed connection of a guide vane to a lever of a guide vane adjusting device of a turbomachine, wherein the guide vane has a vane shaft that extends along a vertical axis. In addition, the invention comprises a turbomachine with a plurality of lever linkages for producing a rotationally fixed coupling of the guide vanes to a guide vane adjusting device.

Compressors in axial turbomachines, such as, for example, in aircraft engines, comprise, as a rule, a guide vane adjusting device in the region of the front compressor stages or in the high-pressure compressor. By way of the guide vane adjusting device, the guide vanes of the relevant guide vane row are adjusted around their vertical axis depending on the rotational speed, so that an absolute outflow angle of the guide wheel can be changed. In this way, it is possible to prevent a flow stall when the turbomachine is started up or when it is operated at low rotational speeds. A stage load is reduced. Alternatively, a flow stall could also be realized by an adjustment of the rotating blades of the compressor stages, but this is substantially more complicated in technical terms, so that the adjustment of the guide vanes has prevailed.

The adjustment of the guide vanes of a guide vane row conventionally occurs mechanically through actuation of an actuating drive. The actuating drive acts on the respective guide vanes, as a rule, by way of an adjusting ring and, in each case, by means of a lever. The adjusting ring is arranged outside of the turbomachine and, as viewed in the direction of flow, is usually positioned behind and coaxial to the guide vane row. It can rotate in the peripheral direction and it can be shifted in the axial direction of the turbomachine. In the case of a plurality of compressor stages that are to be adjusted, the adjusting rings are actuated simultaneously by way of an actuating lever of the actuating drive that is mounted rotatably at the compressor housing and extends in the axial direction of the turbomachine and is connected to the respective adjusting rings.

In the case of known guide vane adjusting devices, the lever is inserted in the radial direction of the turbomachine onto a vane shaft that extends in the vertical direction of the guide vane. Afterwards, as a rule, the lever is fixed in place at a small-surface contact region of the vane shaft in a form-fitting manner and secured by means of a screw connection. The screw connection can be made through an inner thread or through an outer thread. This kind of lever linkage necessitates a sufficiently thick vane shaft for the shaping of the contact surfaces. Because the form-fitting connection is realized, in each case, only at the terminal end and with relatively small contact surfaces, locally higher mechanical stresses, among other things, can result.

SUMMARY OF THE INVENTION

An object of the invention is to specify a lever linkage of a guide vane adjusting device of a turbomachine for producing a rotationally fixed connection between a guide vane and a lever that avoids the previously mentioned drawbacks. In addition, an object of the invention is to specify a turbomachine comprising lever linkages according to the invention.

The object is achieved, first of all, by a lever linkage having the features of the present invention.

In a lever linkage for the rotationally fixed connection of a guide vane to a lever of a guide vane adjusting device of a turbomachine, wherein the guide vane has a vane shaft extending along a vertical axis, the lever is formed in one piece at a radially outer end of an essentially hollow cylindrical clamping sleeve, which surrounds the vane shaft coaxially in sections, and the vane shaft and the clamping sleeve are coupled via a longitudinal side form-fitting connection or a front-end form-fitting connection, and the vane shaft can be clamped with the clamping sleeve along the vertical axis by means of a fastening element, in particular a threaded nut.

A separation of the force flows is thereby obtained, because the vane shaft is essentially subjected only to tensile forces and the clamping sleeve is subjected, at least essentially, only to bending torques by means of the lever, which is formed integrally on it, when the guide vane is adjusted. In comparison to a conventional lever linkage, the risk of creating locally increased mechanical stresses is diminished and, overall, a more uniform load distribution is achieved. The longitudinal side form-fitting connection also extends parallel to the vertical axis of the vane shaft. The threaded nut is usually self-locking in design. Instead of a threaded nut, it is possible, for example, to utilize a threaded bolt as a clamping or fastening element.

Preferably, the clamping sleeve has a collar for radial positional securing of the guide vane in a housing of the turbomachine, with a defined gap being created between the collar and the housing. In consequence thereof, a smooth-running bearing is obtained.

In accordance with a technically advantageous enhancement, a cylindrical bearing section is formed in the housing between a radially inner end of the clamping sleeve and the collar of the clamping sleeve for the pivotable bearing of the guide vanes. In consequence thereof, an especially large contact surface between the clamping sleeve and the housing of the turbomachine is obtained, which results in a robust and durable bearing.

Preferably, at least one bushing is arranged between a bore of the housing and the bearing section of the clamping sleeve. In this way, in the case of a suitable selection of material for the clamping sleeve of the at least one cylindrical bushing this is at least nearly hollow and the housing of the turbomachine in this region, a low-wear bearing is possible. In addition, by means of the at least one bushing, it is possible to realize a tolerance compensation.

Preferably, a threaded section for the threaded nut is formed at a radially outer end of the vane shaft. In consequence thereof, a mechanically reliable, as well as, if need be, detachable connection between the vane shaft and the clamping sleeve is obtained.

Preferably, the radially outer plate of the guide vane forms a contact surface for the radially inner end of the clamping sleeve. In this way, a one-sided thrust bearing for the clamping sleeve is obtained at the vane shaft.

In the case of a first embodiment variant of the lever linkage, the vane shaft has a longitudinal outer toothing with a first recess below the threaded section and the clamping sleeve has a longitudinal inner toothing with a second recess in the region of the lever for creation of the longitudinal side form-fitting connection, wherein the two recesses are formed in such a way that a locking plate, which can be accommodated in a precisely fit manner in the recesses, can be clamped between the vane shaft and the lever for free-of-play connection thereof when the vane shaft is clamped with the clamping sleeve. In this way, a permanently free-of-play, rotationally fixed connection between the clamping sleeve with the lever and the vane shaft is obtained. A transmission of the adjusting torques occurs by means of the longitudinal side form-fitting connection, whereas the transmission of bending torques takes place via the clamping sleeve with the lever, thereby bringing about a distribution of these various force flows. Beyond this, the locking plate serves for the positional securing of the preferably self-locking threaded nut.

In the case of a second embodiment of the lever linkage, the front-end form-fitting connection is formed with a first front-end toothing directed in the direction of the outer radial end of the vane shaft at the radially outer plate and with a second front-end toothing directed in the direction of the first front-end toothing at the radially inner end of the clamping sleeve. On account of the front-end toothings, which are oppositely oriented and engage with one another in an at least sectional form-fitting manner, a permanently free-of-play connection between the clamping sleeve with the lever and the vane shaft is obtained. Beyond this, the two front-end toothings ensure a flawless centering of the clamping sleeve in relation to the vane shaft. As a result, the vane shaft remains completely free of bending or torsional torques and, accordingly, is exclusively subjected to tensile forces, as a result of which a strict separation of force flows results and the occurrence of local mechanical stresses inside the guide vane is prevented to the greatest degree possible.

Preferably, the two front-end toothings each have an irregular tooth pitch. In consequence thereof, a clear angular position between the vane shaft and the clamping sleeve is obtained so as to facilitate the mounting of the lever linkage.

In the case of a technically favorable embodiment, in the region of the clamping sleeve and/or of the lever, a recess for a locking plate is provided for the positional securing of the threaded nut. In this way, besides the threaded nut that preferably has a self-locking design, another securing of the threaded nut against unintended loosening is obtained.

Preferably, the vane shaft has an at least nearly cylindrical centering collar, which abuts, at least in sections, an inner centering section in the region of the radially outer end of the clamping sleeve. In this way, the vane shaft is guided reliably in the clamping sleeve.

A turbomachine according to the invention is equipped with a plurality of lever linkages for producing a rotationally fixed connection of guide vanes to a guide vane adjusting device. In consequence thereof, a decoupling of the force flows is obtained, as a result of which the risk of occurrence of local peaks in mechanical stress is avoided.

BRIEF DESCRIPTION OF THE DRAWING FIGURES

Figure 2:
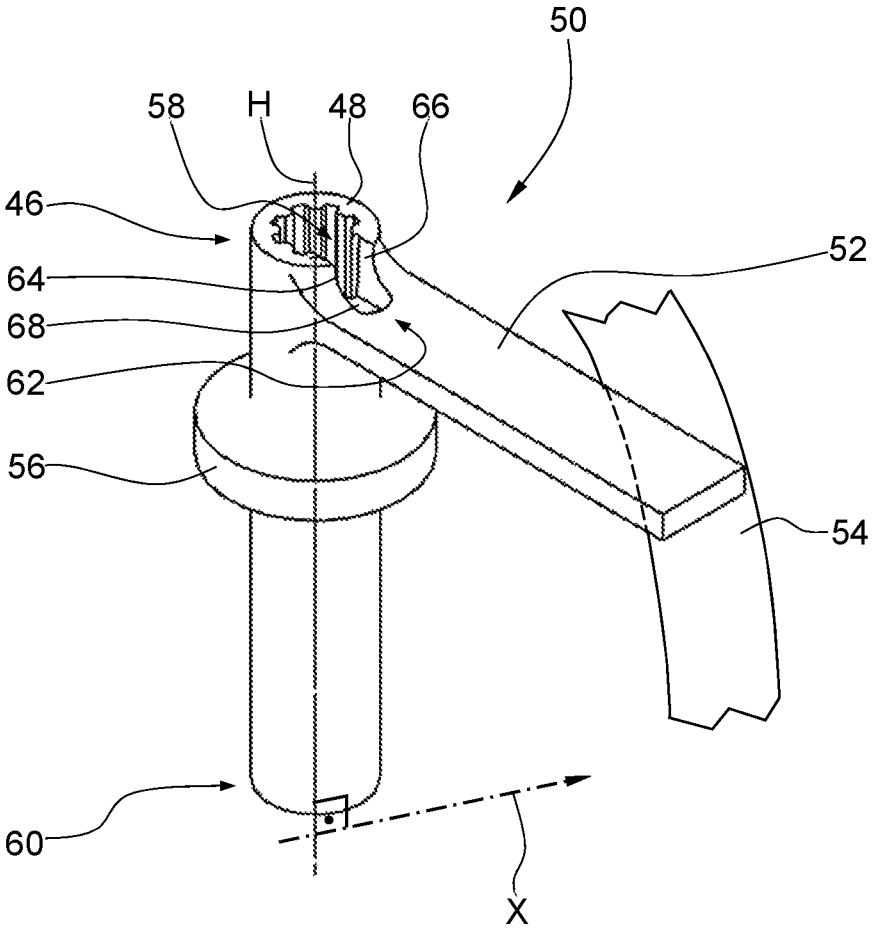
Figure 3:
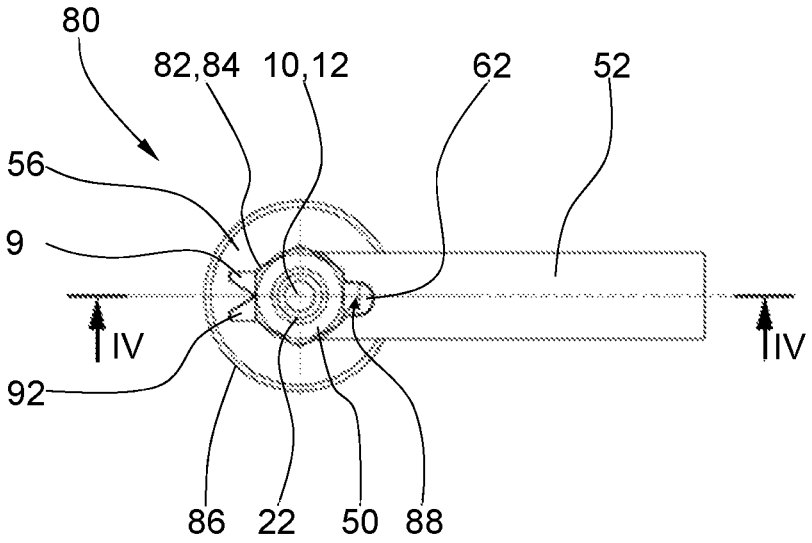
Figure 4:
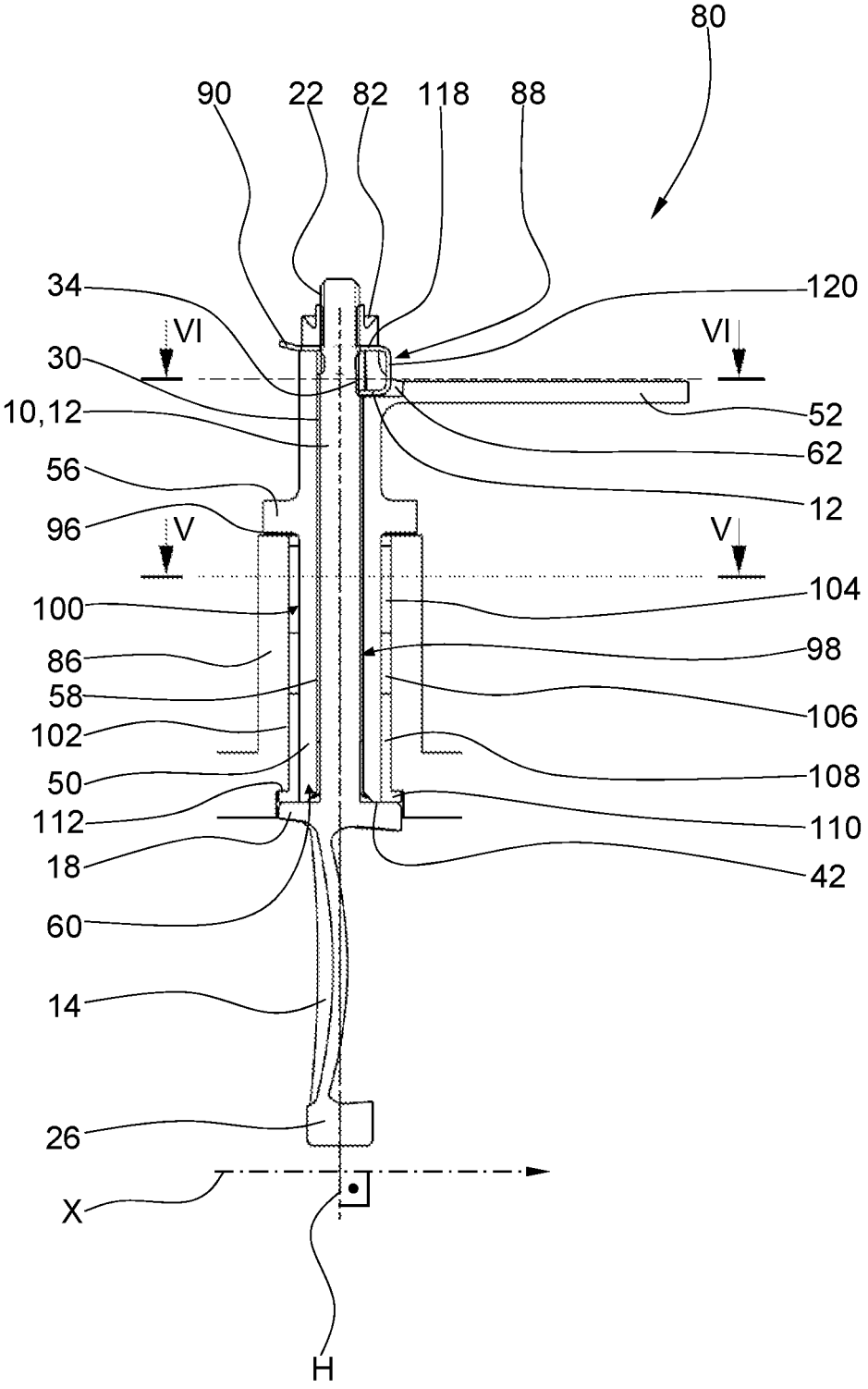
Figure 5:
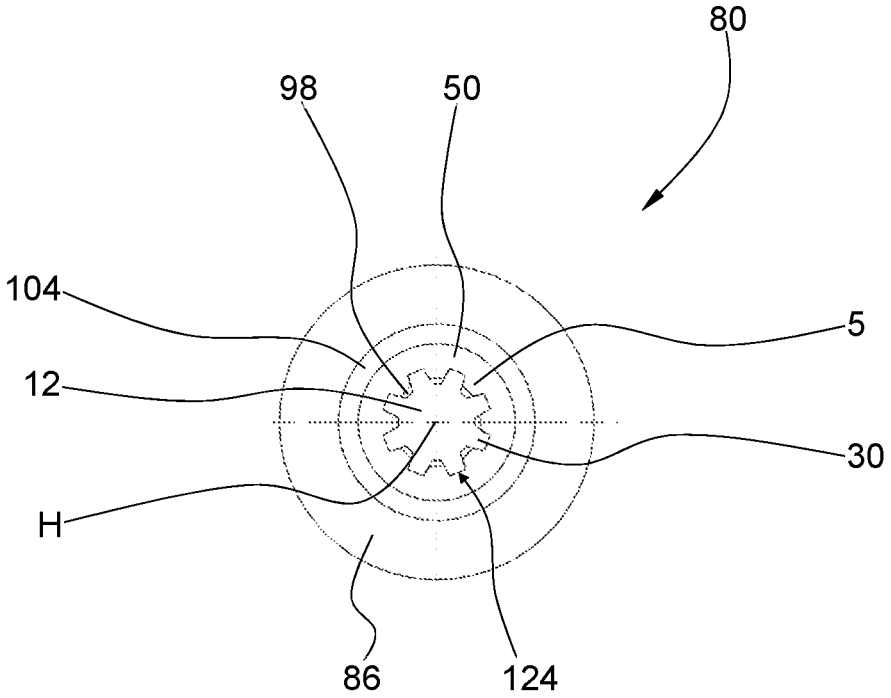
Figure 6:
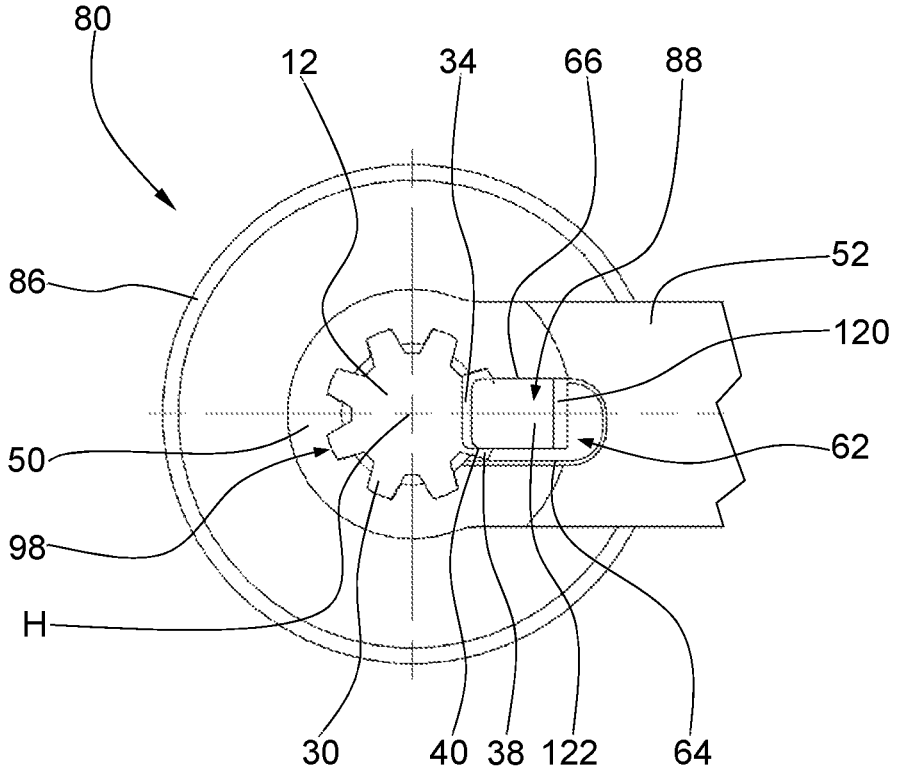
Figure 7:
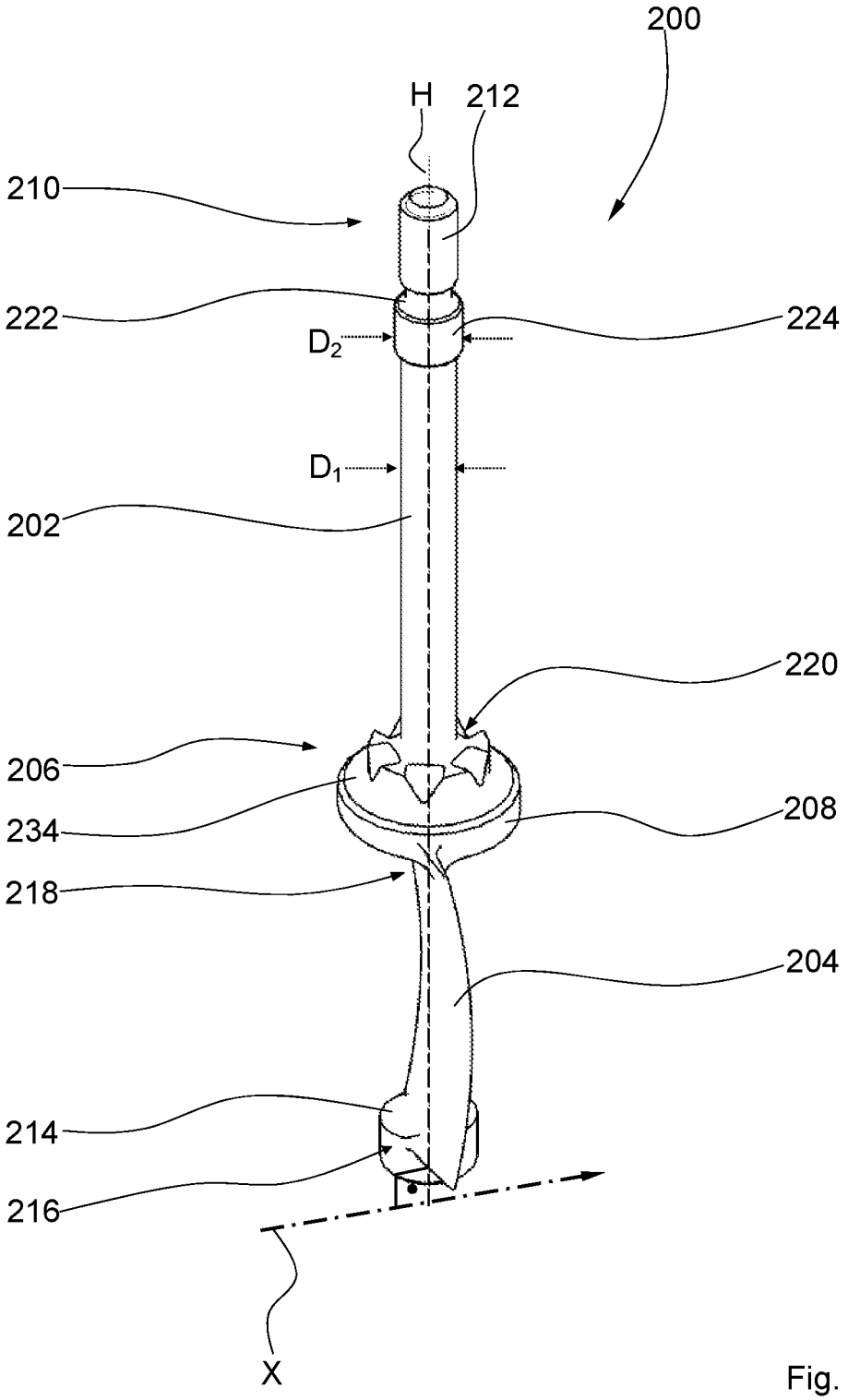
Figure 8:
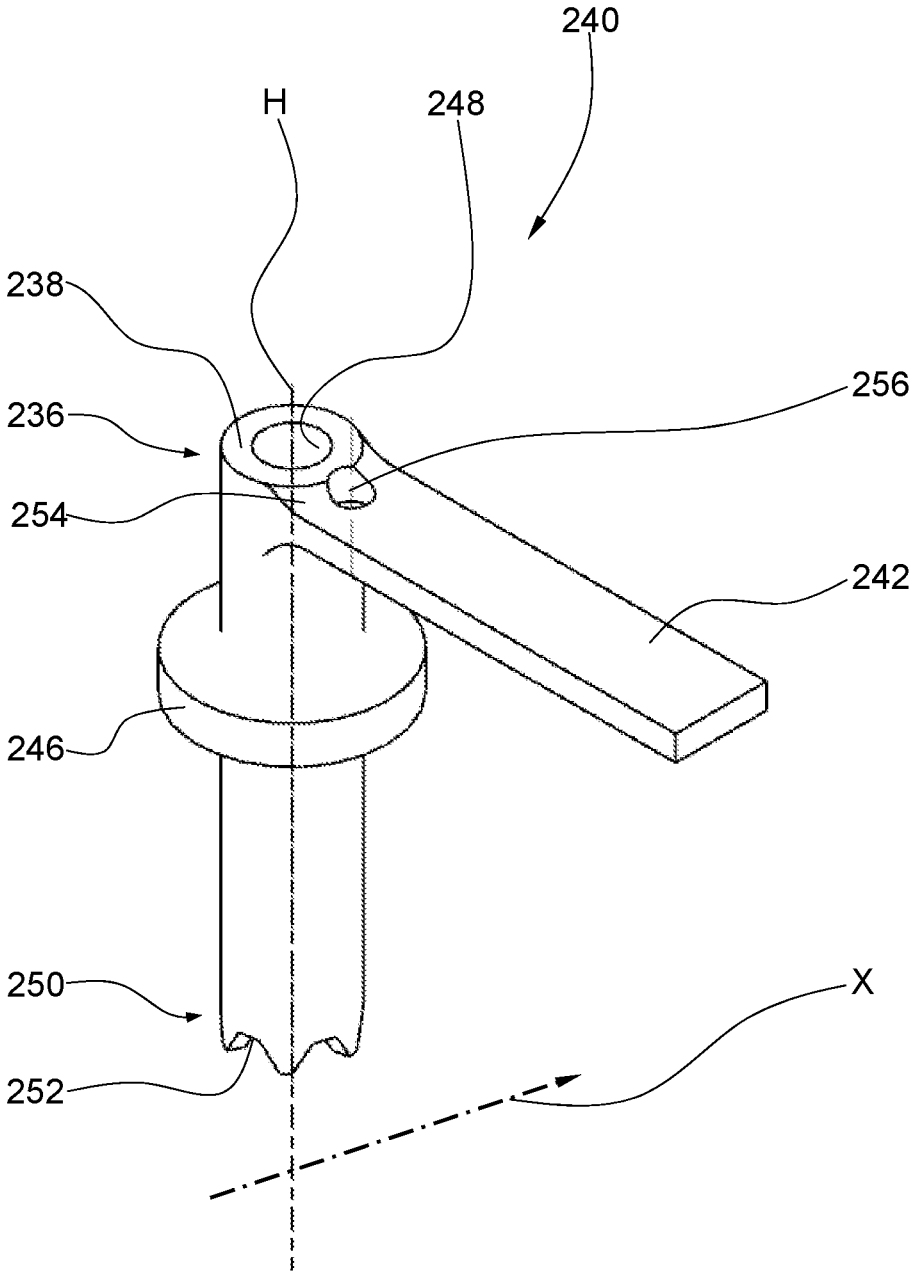
Figure 9:
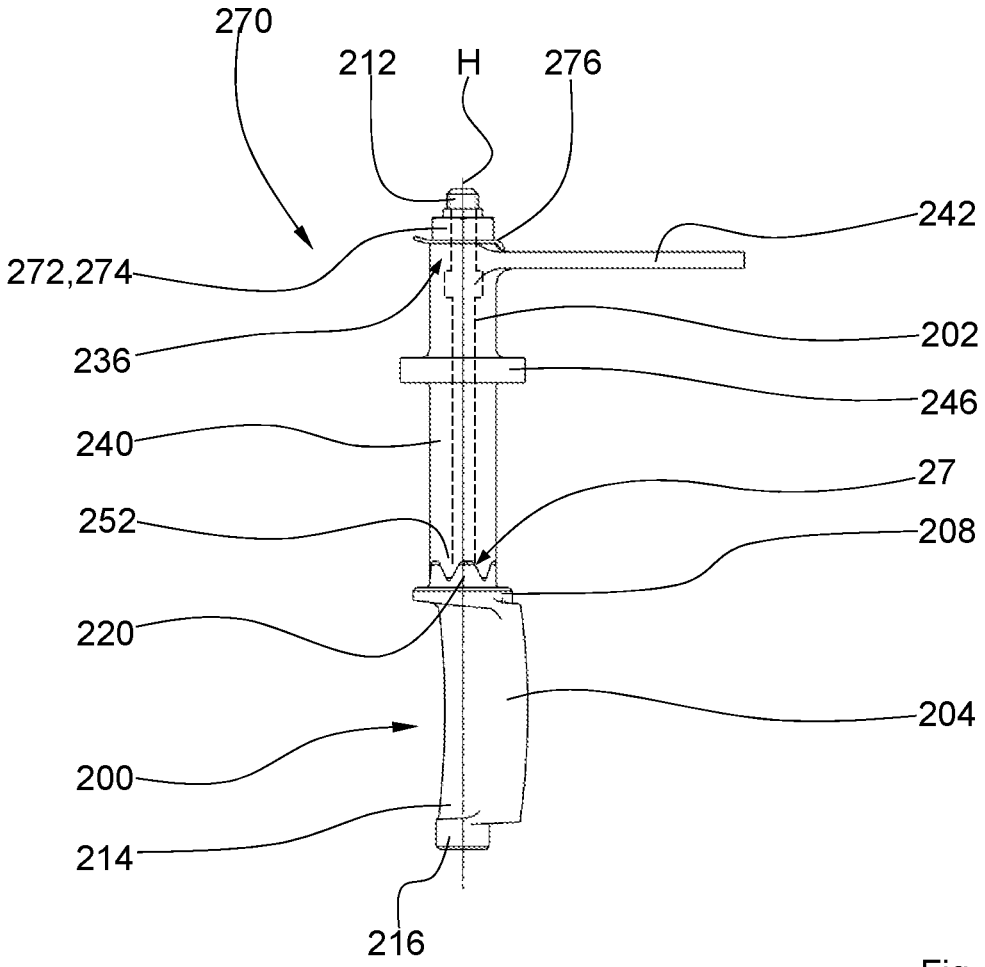
Figure 10:
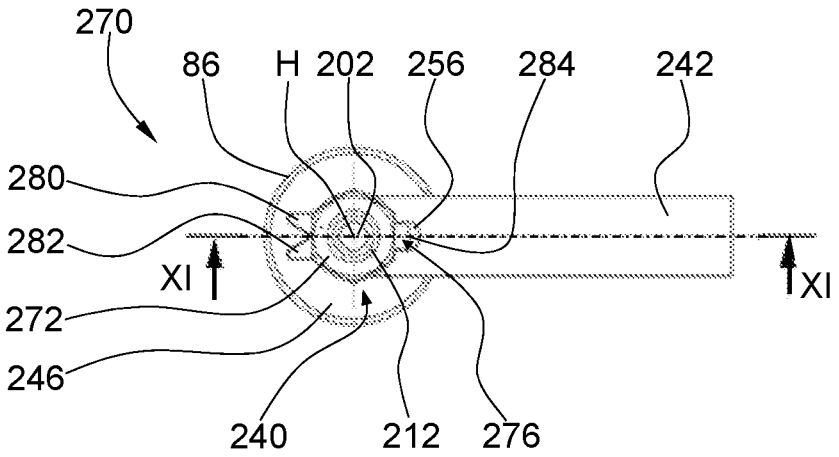
Figure 11:
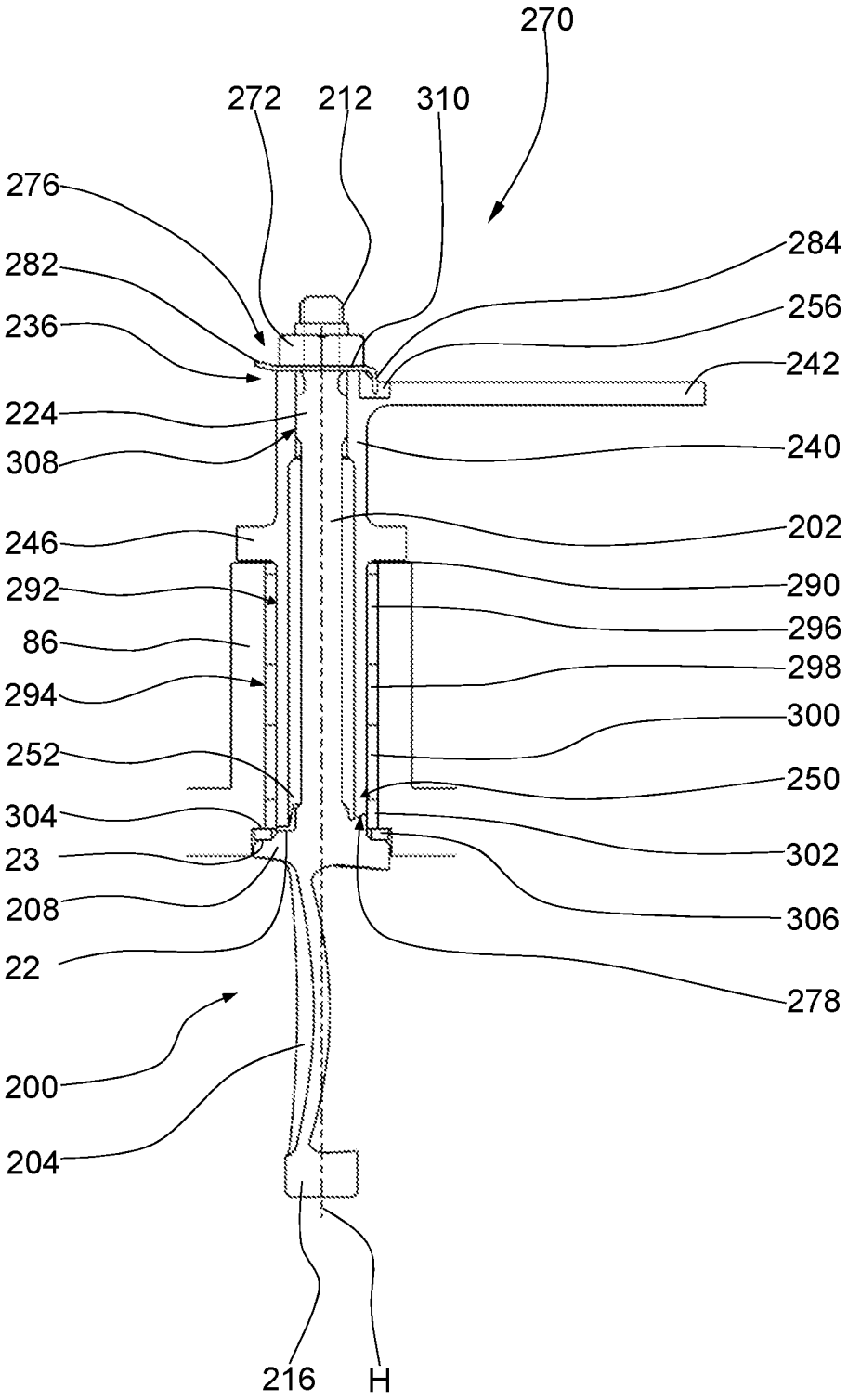

Shown schematically are:

FIG. 1: a perspective view of a guide vane for a first embodiment variant of a lever linkage;

FIG. 2: a perspective view of a clamping sleeve, which has a lever formed laterally on it in one piece, for the first embodiment variant of the lever linkage;

FIG. 3: a plan view onto the first embodiment variant of the lever linkage in a mounted state;

FIG. 4: a longitudinal section of the mounted lever linkage of FIG. 3 along the sectioning line IV-IV;

FIG. 5: a cross section of the lever linkage of FIG. 4 along the sectioning line V-V;

FIG. 6: a cross section of the lever linkage of FIG. 4 along the sectioning line VI-VI;

FIG. 7: a perspective view of a guide vane for a second embodiment variant of a lever linkage;

FIG. 8: a perspective view of a clamping sleeve, which has a lever formed laterally on it in one piece, for the second embodiment variant of the lever linkage;

FIG. 9: a schematic side view of the second embodiment variant of the lever linkage in a mounted state;

FIG. 10: a plan view of the mounted second embodiment of the lever linkage of FIG. 9;

FIG. 11: a longitudinal section through the mounted lever linkage of FIG. 10 along the sectioning line XI-XI.

DESCRIPTION OF THE INVENTION

In the context of the present description, the terms "radial", "radially outward," "radially outer", "radially inward", and "radially inner"—unless another orientation is otherwise explicitly stated—refer to a machine longitudinal axis X of the turbomachine according to the invention that incorporates the axis of rotation of a rotor of the turbomachine. Terms such as "lateral" and "cross" refer to a vertical axis H of a guide vane of the turbomachine that extends essentially radially to the machine longitudinal axis X.

FIG. 1 shows a perspective view of a guide vane for a first embodiment variant of a lever linkage. A guide vane 10, illustrated in its installed position, among other things, has a vane shaft 12, which extends along a vertical axis H and has a vane element or vane body 14. The guide vane 10 can be mounted in a turbomachine housing, which is also not illustrated here, so as to pivot around the vertical axis H. The machine longitudinal axis X of the turbomachine extends perpendicularly to the vertical axis H. Formed at a radially inner end 16 of the vane shaft 12 is a radially outer plate 18, which is larger in diameter. Provided at a radially outer end 20 of the vane shaft 12 is a threaded section 22. A radially inner vane body root 24 of the vane body 14 transitions into a radially inner plate 26, which is smaller in diameter, whereas a radially outer vane body root 28 transitions into the plate 18, which is larger in diameter.

A longitudinal outer toothing 30, which extends parallel to the vertical axis H, is formed at least in sections at the vane shaft 12. The longitudinal outer toothing 30 can be designed as a uniform involute toothing, a trapezoidal toothing, a triangular toothing, or the like. Between the threaded section 22 and the longitudinal outer toothing 30, there is a fillet-like ring groove 32 or a constriction of the vane shaft 12. Introduced in the vane shaft 12 is a roughly cuboid recess 34, which extends parallel to the vertical axis H and, starting from the ring groove 32, extends over a small length L in the direction of the radially inner end 16 of the vane shaft 12. The recess 34 accommodates completely at least one tooth 36 of the longitudinal outer toothing 30, and here, by way of example, another tooth 38, which is directly adjacent to it on the circumferential side, with only a narrow side wall 40 of the tooth 38 remaining standing. The recess 34 serves for receiving a locking plate, which is not illustrated here (compare, in particular, FIGS. 3, 4, 6). The plate 18 further has a contact surface 42 of roughly circular ring shape for a clamping sleeve of the lever linkage (compare, in particular, FIG. 2).

FIG. 2 shows a perspective view of a clamping sleeve, which has a lever formed laterally on it in one piece, for the first embodiment variant of the lever linkage. In the region of a radially outer end 46 of an essentially hollow cylindrical base body 48 of a clamping sleeve 50, a lever 52 of a guide vane adjusting device 54—which is only roughly indicated in the drawing—of the turbomachine is formed in one piece.

The clamping sleeve 50 has a roughly disk-shaped collar 56 for radial positional securing of the guide vane in a housing—which is not illustrated here—of the turbomachine. The clamping sleeve 50 has a longitudinal inner toothing 58, which is designed in correspondence to the longitudinal outer toothing of the vane shaft (compare, in particular, FIG. 1) and which extends parallel to the vertical axis H, starting from the radially outer end 46, down to a radially inner end 60 of the clamping sleeve 50. The vertical axis H extends, in turn, orthogonally to the machine longitudinal axis X. A recess 62 for the locking plate is provided at the radially outer end 46 of the clamping sleeve 50 in the region of the base body 48 of the clamping sleeve as well as in the lever 52. The recess 62 has a first side wall 64 and a second side wall 66 as well as a bottom 68, wherein the side walls 64, 66 are oriented perpendicular to the bottom 68.

FIG. 3 illustrates a plan view of the first embodiment variant of the lever linkage in a mounted state. In a mounted state of a lever linkage 80 according to the invention, the threaded section 22 at the vane shaft 12 of the guide vane 10 is connected to the clamping sleeve 50 by means of a preferably self-locking threaded nut 82 as a fastening element 84 and is mounted pivotably in a housing 86 of the turbomachine by means of the lever 52. In this case, the collar 56 of the clamping sleeve 50 secures the guide vane on one side in the radial direction. A locking plate 88 has two at least essentially triangular lugs 90, 92, which, for locking of the threaded nut 82, can be brought into contact with it by corresponding bending. The locking element 88 lies, at least in sections, in the recess 62 of the lever 52 of the clamping sleeve 50. When the lever linkage 80 is mounted by firmly turning or tightening the threaded nut 82, the locking plate 88 is firmly clamped at least in sections between it and the clamping sleeve 50 and the recess 62 in the lever 52, as well as the recess in the vane shaft 12, which is covered up here.

FIG. 4 shows a longitudinal section of the mounted lever linkage of FIG. 3 along the sectioning line IV-IV. The guide vane 10 comprises the vane shaft 12 and the vane body 14, as well as the radially outer plate 18 and the radially inner plate 26. The guide vane 10 is situated in its installed position in relation to the machine longitudinal axis X. The vane shaft 12 of the guide vane 10 is inserted in the clamping sleeve 50 to create the lever linkage 80 and is tensioned by means of the threaded nut 82, which is screwed onto the threaded section 22, with a narrow gap 96 remaining between the collar 56 of the clamping sleeve 50 and the housing 86. Accordingly, a longitudinal side form-fitting connection 98 exists between the longitudinal outer toothing 30 of the vane shaft 12 and the longitudinal inner toothing 58 of the clamping sleeve 50.

Formed between the radially inner end 60 of the clamping sleeve 50 and the collar 56 is a cylindrical bearing section 100 for pivotable bearing of the guide vane 10 in a stepped bore 102 of the housing 86. Arranged between the bearing section 100 and the stepped bore 102 are here, by way of example, three at least nearly hollow cylindrical bushings 104, 106, 108, wherein a collar 110, which is directed perpendicularly away from the vertical axis, is integrally shaped at the bushing 108 and lies between the plate 18 and a shoulder 112 of the stepped bore 102. The plate 18 further has the contact surface 42 as a thrust bearing of the guide vane 10 and the clamping sleeve 50, which are tensioned against each other along the vertical axis H.

By means of the lug 90 and the second lug, which is not visible here, of the locking plate 88, there is an additional rotational securing of the threaded nut 82, which, in addition, is preferably self-locking. The locking plate 88 further has a bore section 118 for through passage of the threaded sections 22 of the vane shaft 12, a back section 120, which adjoins it perpendicularly, that is, which extends parallel to the vertical axis H, and a clamping section 122, which is oriented parallel to the machine longitudinal axis X and lies in the recess 34 of the longitudinal outer toothing 30 of the vane shaft 12 and in the recess 62 of the lever 52 of the clamping sleeve 50. In this case, the two recesses 34, 62 are designed in accordance with the invention in such a way that, when the vane shaft 12 is clamped with the clamping sleeve 50, at least the clamping section 122 of the locking plate 88 is clamped in a wedge-like manner between the vane shaft 12 and the lever 52 for the free-of-play connection thereof. A cross-sectional geometry of the bore section 118, of the back section 120, and of the clamping section 122 of the locking plate 88 is roughly U-shaped.

Through the formation of the lever linkage 80 in accordance with the invention, a separation of force flows acting on the guide vane 10 is ensured for protection against local load peaks, because adjusting torques are transmitted by way of the longitudinal side form-fitting connection 98 and bending or torsional torques are transmitted through the lever 52 and the clamping sleeve 50 onto the guide vane 10.

FIG. 5 shows a cross section of the lever linkage of FIG. 4 along the sectioning line V-V. The lever linkage 80 is formed, among other things, with the longitudinal outer toothing 30 of the vane shaft 12, which engages with the longitudinal inner toothing 58 of the clamping sleeve 50 and, in this case, represents the longitudinal side form-fitting connection 98. The clamping sleeve 50 with the vane shaft 12, which is mounted on it coaxially and in sections in a form-fitting manner, is mounted in the housing 86 so as to pivot around the vertical axis H in order to make possible different setting angles of the vane shaft 12, which is not illustrated here. The centering of the vane shaft 12 in the clamping sleeve 50 occurs here preferably at an outer diameter 124 of the longitudinal side form-fitting connection 98. The bushing 104 ensures, among other things, a smooth-running and low-friction pivotability of the clamping sleeve 50 in the housing 86.

FIG. 6 illustrates a cross section of the lever linkage of FIG. 4 along the sectioning line VI-VI. The vane shaft 12 is connected to the clamping sleeve 50 in a rotationally fixed manner by means of the longitudinal side form-fitting connection 98 of the lever linkage 80 and by means of the lever 52 formed integrally on it and is mounted in the housing 86 so as to pivot around the vertical axis H. The clamping section 122 of the locking plate 88 lies in the recess 62 of the lever 52 and in the recess 34 of the longitudinal outer toothing 30 of the vane shaft 12. The clamping section 122 is clamped in a wedge-like manner between the side wall 40 of the remaining (residual) tooth 38 and the opposite-lying side wall 66 of the recess of the lever 62 by tightening the threaded nut, which is not illustrated here, when the lever linkage 80 is mounted. In consequence thereof, any circumferential play in the longitudinal side form-fitting connection 98 in relation to the vertical axis H is permanently and reliably eliminated. In this case, the clamping section 122 is connected to the bracket-shaped or clamp-like locking plate 88 by means of the back section 120, which extends parallel to the vertical axis H. Here, the locking plate 88 brings about, by way of example, both the redundancy of the positional securing of the threaded nut and the freedom of play of the lever linkage 80.

FIG. 7 shows a perspective view of a guide vane for a second embodiment variant of a lever linkage. A guide vane 200, which, once again, is illustrated in its installed position, comprises an at least essentially cylindrical vane shaft 202 and a vane body 204. In order to highlight the spatial position of the components inside the turbomachine, the vertical axis H as well as the machine longitudinal axis X are marked once again. The vane shaft 202 has a radially inner end 206, in the region of which a radially outer plate 208, which is larger in diameter, is formed in analogy to the first embodiment variant. Provided at a radially outer end 210 of the vane shaft 202 is a threaded section 212. A radially inner vane body root 214 of the vane body 204 transitions into a radially inner plate 216, which is smaller in diameter, whereas a radially outer vane body root 218 abuts the plate 208. In distinction to FIG. 1, instead of a longitudinal outer toothing of the vane shaft 202 at the plate 208, a front-end toothing 220 with an irregular tooth pitch is provided, which is directed in the direction of the threaded section 212 or of the radially outer end 210 of the vane shaft 202. The front-end toothing 220 can have teeth that have practically any desired geometry differing from the usual involute form. Along the vertical axis H in the direction of the plate 208, a ring groove 222 as well as a cylindrical centering collar 224 adjoin the threaded section 212 of the vane shaft 202. The centering collar 224 has a diameter $D_2$ that is slightly larger in comparison to a diameter $D_1$ of the vane shaft 202. Provided peripherally to the front-end toothing 220, furthermore, there is a contact surface 234, which is directed in the direction of the radially outer end 210 of the vane shaft 202, for the clamping sleeve of the lever linkage for guide vane adjustment (compare FIG. 2, reference number 54).

FIG. 8 illustrates a perspective view of a clamping sleeve, which has a lever formed laterally on it in one piece, for the second embodiment variant of the lever linkage. Formed at a radially outer end 236 of an at least nearly hollow cylindrical base body 238 of a second embodiment variant of a clamping sleeve 240, which is drawn in its installed position, is, in turn, a lever 242, preferably in one piece, for connection of the guide vane adjusting device, which is not illustrated here (compare FIG. 2, reference number 54). Integrally formed at the base body 238 of the clamping sleeve 240 in correspondence to the embodiment variant of FIG. 2 is, in turn, a surrounding collar 246 or a flange, which extends radially outward perpendicularly to the vertical axis H. In distinction to the longitudinal inner toothing of the first embodiment variant of the clamping sleeve (compare FIG. 2), the base body 238 of the clamping sleeve 240 has a cylindrical through-bore 248, which extends concentrically to the vertical axis H. In this case, the vertical axis H is oriented, in turn, at a right angle to the machine longitudinal axis X. Provided at a radially inner end 250 of the clamping sleeve 240, as a further difference in design, is a second front-end toothing 252 with an irregular tooth pitch, which corresponds to the front-end toothing of the vane shaft of FIG. 7. In a fillet-like transition zone 254 between the radially outer end 236 of the clamping sleeve 240 and the lever 242, a bore 256 or a recess is introduced for at least partial mounting of a locking plate, which is not illustrated here.

FIG. 9 shows a schematic side view of the second embodiment variant of the lever linkage in a mounted state. The vane shaft 202 with the vane body 204, which is only roughly indicated in the drawing, is inserted in the clamping sleeve 240 for creation of the second embodiment variant of a lever linkage 270. The vane shaft 202 and the clamping sleeve 240 with the lever 242 as well as with the flange-like collar 246 are mechanically tensioned against each other along the vertical axis H by means of a threaded nut 272, which is self-locking in design, and which, as a fastening element 274, is screwed onto the threaded section 212. Between the threaded nut 272 and the radially outer end 236 of the clamping sleeve 240, furthermore, there is arranged a locking plate 276 for redundant rotational locking of the threaded nut 272 against uncontrolled loosening. The clamping sleeve 240 coaxially surrounds the vane shaft 202 of the guide vane 200 in sections in the mounted state. In the mounted state of the lever linkage 270 shown here, the front-end toothing 220 of the plate 208 exists in form-fitting engagement with the correspondingly formed front-end toothing 252 of the clamping sleeve 240 with the creation of a front-end form-fitting connection 278 in accordance with the invention, which, at the same time, acts in a centering manner. The radially inner vane body root 214 transitions into the plate 216, which is smaller in diameter.

The second embodiment variant of the lever linkage 270 also makes possible an effective separation of the force flows or torques acting on the guide vane 200, because, in order to minimize local mechanical stresses, the vane shaft 202 is subjected exclusively to tensile forces and the clamping sleeve 240 is subjected only to bending or torsional torques.

FIG. 10 shows a plan view of the mounted second embodiment of the lever linkage of FIG. 9. The clamping sleeve 240 of the fully mounted lever linkage 270 is fixed in position radially, at least on one side, by means of the collar 246 in the housing 86 of the turbomachine and is accommodated by means of the lever 242 so as to pivot around the vertical axis H. For this purpose, the vane shaft 202 is tensioned with the clamping sleeve 240 in the direction of the vertical axis H by means of the threaded nut 272, which is screwed onto the threaded section 212 thereof. For positional securing of the threaded nut 272, the locking plate 276, which has a first lug 280 and a second lug 282, is placed between it and the clamping sleeve 240. Furthermore, the locking plate 276 has an engagement section 284, which extends parallel to the vertical axis H and which is accommodated at least sectionally in the bore 256 of the lever 242.

FIG. 11 depicts a longitudinal section through the mounted lever linkage of FIG. 10 along the sectioning line XI-XI. The vane shaft 202 of the guide vane 200 is tensioned with the clamping sleeve 240 along the vertical axis H by means of the threaded nut 272, which is screwed onto the threaded section 212, in order to produce the lever linkage 270, with a defined gap 290 remaining between the housing 86 and the collar 246 of the clamping sleeve 240. In this way, a smooth pivotability of the guide vane 200 around the vertical axis H is ensured through actuation of the lever 242, which is formed integrally with respect to the clamping sleeve 240, by means of the guide vane adjusting device—which is not illustrated here—of the turbomachine (compare FIG. 2, reference number 54). The rotationally fixed and, at the same time, permanently free-of-play connection between the vane shaft 202 of the guide vane 200 and the clamping sleeve 240 is ensured by the front-end form-fitting connection 278 tensioned along the vertical axis H, which is formed by way of the front-end toothing 220 of the plate 208 and the front-end toothing 252 at the radially inner end 250 of the clamping sleeve 240 that is found in engagement therewith. The vane 204 is formed between the plate 208 and the plate 216 integrally to the latter, which is smaller in diameter.

Formed in a stepped bore 294 of the housing 86 between the radially inner end 250 of the clamping sleeve 240 and the collar 246 thereof is a cylindrical bearing section 292 for pivotable bearing of the guide vane 200. Between the bearing section 292 and the stepped bore 294, there are arranged here, solely by way of example, four respective, at least nearly hollow cylindrical bushings 296, 298, 300, 302, wherein, between the bushing 302 that is situated furthest in the direction of the plate 208 and the circular ring-shaped contact surface 234 of the plate 208 as well as of a shoulder 304, a hollow cylindrical insert 306 is present. The contact surface 234 serves as a thrust bearing of the guide vane 200 and clamping sleeve 240, which are tensioned against each other along the vertical axis H for creation of the lever linkage 270. In addition, the centering collar 224 of the vane shaft 202 abuts an inner centering section 308 of the clamping sleeve 240 for further optimization of the guide.

The hook-like locking plate 276 comprises two triangular lugs, of which here only the lug 282 can be seen, at which a bore section 310 adjoins, at which the engagement section 284 adjoins at a right angle. The redundant positional securing of the threaded nut 272 takes place by means of the locking plate 276, through the center bore section 310 of which the threaded section 212 of the vane shaft 202 extends and which is clamped between the tightened threaded nut 272 and the radially outer end 236 of the clamping sleeve 240. In order to ensure the locking purpose, the two triangular lugs of the locking plate 276 can be bent to bring them to rest against the threaded nut 272 or against at least two of the hexagonal faces thereof. In order to complete the positional securing of the threaded nut 272, the bore section 310 of the locking plate 276 is accommodated in the bore 256 of the lever 242 of the clamping sleeve 240.

The invention relates to two embodiment variants of a lever linkage for the pivoting of guide vanes in a compressor part of a turbomachine, wherein, by way of a clamping sleeve, a separation of the acting force and torque flows is realized in such a way that the vane shaft is subjected essentially only to tensile forces and the clamping sleeve is subjected primarily to bending or torsional torques. In consequence thereof, local mechanical load peaks are substantially reduced. In addition, the lever linkage is permanently free of play and is redundantly secured against uncontrolled loosening. Further disclosed is a turbomachine with a plurality of lever linkages according to the invention for the adjustment of guide vanes in a compressor part by means of the guide vane adjusting device.

What is claimed is:

1. A lever connection for rotationally fixed connection of a guide vane to a lever of a guide vane adjusting device of a turbomachine, the guide vane has a vane shaft, which extends along a vertical axis, the lever connection comprising, the lever is formed in one piece with, an essentially hollow cylindrical clamping sleeve, wherein the essentially hollow cylindrical clamping sleeve extends in a radial direction parallel to the vertical axis, and the lever is formed at a radially outer end, along the radial direction, of the essentially hollow cylindrical clamping sleeve, the clamping sleeve coaxially surrounds the vane shaft in sections, and the vane shaft and the clamping sleeve are coupled by way of a longitudinal side form-fitting connection or a front-end form-fitting connection, and the vane shaft is configured and arranged to be tensioned by the clamping sleeve along the vertical axis by a threaded nut threaded on to the vane shaft, wherein the clamping sleeve has a collar for the radial positional securing of the guide vane in a housing of the turbomachine.

2. The lever linkage according to claim 1, wherein, between the collar and the housing, there is a defined gap.

3. The lever linkage according to claim 1 wherein, between a radially inner end of the clamping sleeve and the collar of the clamping sleeve, a cylindrical bearing section is formed for pivotable bearing of the guide vane in the housing.

4. The lever linkage according to claim 3, wherein, between a bore of the housing and the bearing section of the clamping sleeve, at least one hushing is arranged.

5. The lever linkage according to claim 1, wherein, at a radially outer end of the vane shaft, a threaded section for the threaded nut is formed.

6. The lever linkage according to claim 1, wherein a radially outer plate of the guide vane forms a contact surface for a radially inner end of the clamping sleeve.

7. The lever linkage according to claim 1, wherein the vane shaft has a longitudinal outer toothing with a recess below the threaded section and the clamping sleeve has a longitudinal inner toothing with a recess in the region of the lever for the creation of the longitudinal side form-fitting connection, wherein a locking plate, accommodated in the two recesses in a form-fit manner, the locking plate is clamped between the vane shaft and the lever for the free-of-play connection thereof when the vane shaft is clamped with the clamping sleeve.

8. The lever linkage according to claim 1, wherein the front-end form-fitting connection is formed with a first front-end toothing at the radially outer plate and with a second front-end toothing, which is directed in the direction of the first front-end toothing, at the radially inner end of the clamping sleeve.

9. The lever linkage according to claim 8, wherein the two front-end toothings each have an irregular tooth pitch.

10. The lever linkage according to claim 8 wherein, in the region of the clamping sleeve and/or of the lever, a bore for a locking plate is provided for the positional securing of the threaded nut.

11. The lever linkage according to claim 8, wherein the vane shaft has an at least approximately cylindrical centering collar, which, at least in sections, abuts an inner centering section in the region of the radially outer end of the clamping sleeve.

12. The lever linkage according to claim 1, wherein a plurality of lever linkages are configured and arranged for producing a rotationally fixed connection of guide vanes to a guide vane adjusting device in a turbomachine.

* * * * *